US009718654B2

(12) United States Patent
Kobayashi et al.

(10) Patent No.: US 9,718,654 B2
(45) Date of Patent: Aug. 1, 2017

(54) TELESCOPIC BOOM

(71) Applicant: TADANO LTD., Kagawa (JP)

(72) Inventors: Kazuhiro Kobayashi, Takamatsu (JP); Kenji Tanaka, Takamatsu (JP)

(73) Assignee: TADANO LTD., Kagawa (JP)

( * ) Notice: Subject to any disclaimer, the term of this patent is extended or adjusted under 35 U.S.C. 154(b) by 149 days.

(21) Appl. No.: 14/040,276

(22) Filed: Sep. 27, 2013

(65) Prior Publication Data

US 2014/0083968 A1 Mar. 27, 2014

(30) Foreign Application Priority Data

Sep. 27, 2012 (JP) ..... 2012-214055

(51) Int. Cl.
*B66C 23/70* (2006.01)
*B66C 23/687* (2006.01)

(52) U.S. Cl.
CPC ..... *B66C 23/701* (2013.01)

(58) Field of Classification Search
CPC ..... B66C 23/70; B66C 23/701; B66C 23/04; B66C 23/64; B66C 23/702; B66C 23/703; B66C 23/705; B66C 23/706; B66C 23/707; B66C 23/708
USPC ..... 212/347, 348–350
See application file for complete search history.

(56) References Cited

U.S. PATENT DOCUMENTS

| | | | | |
|---|---|---|---|---|
| 5,884,791 | A | 3/1999 | Vohdin et al. | |
| 6,098,824 | A | 8/2000 | Krebs et al. | |
| 2003/0071005 | A1 * | 4/2003 | Higgins | B66C 23/708 212/298 |
| 2010/0155356 | A1 | 6/2010 | Wimmer | |

FOREIGN PATENT DOCUMENTS

| | | | | |
|---|---|---|---|---|
| BE | 733510 | | 11/1969 | |
| CN | 1073047 | C | 10/2001 | |
| DE | 19711975 | A1 | 9/1998 | |
| DK | WO 02064485 | A2 * | 8/2002 | B66C 23/185 |
| EP | 0814050 | A1 | 12/1997 | |
| JP | H02-75489 | U | 6/1990 | |
| JP | 2005-112514 | A | 4/2005 | |
| JP | 2006-021877 | A | 1/2006 | |

(Continued)

OTHER PUBLICATIONS

The first Office Action issued by the Chinese Patent Office on Feb. 3, 2015, which corresponds to Chinese Patent Application No. 201310428622.X and is related to U.S. Appl. No. 14/040,276.

(Continued)

*Primary Examiner* — Sang Kim
*Assistant Examiner* — Juan Campos, Jr.
(74) *Attorney, Agent, or Firm* — Studebaker & Brackett PC

(57) ABSTRACT

A telescopic boom includes a first frame having a curved portion whose section is substantially U-shaped, and a second frame connected to the first frame so that a closed section is formed. In the telescopic boom, the U-shaped curved portion of the first frame includes a plurality of protrusion portions formed at intervals in a circumferential direction of the telescopic boom, each protrusion portion extending in a longitudinal direction of the telescopic boom and being formed to have an arc-shaped section and protrude to the outside of the first frame.

6 Claims, 5 Drawing Sheets

(56) References Cited

FOREIGN PATENT DOCUMENTS

WO 2009029967 A1 3/2009

OTHER PUBLICATIONS

The extended European search report issued on Jan. 29, 2014, which corresponds to European Patent Application No. 13186212.0-1705 and is related to U.S. Appl. No. 14/040,276.
An Office Action; "Notice of Reasons for Rejection," issued by the Japanese Patent Office on May 17, 2016, which corresponds to Japanese Patent Application No. 2012-214055 and is related to U.S. Appl. No. 14/040,276.

* cited by examiner

TELESCOPIC BOOM

CROSS REFERENCE TO RELATED APPLICATION

The present application claims priority to Japanese Patent Application No. 2012-214055 filed Sep. 27, 2012 to the Japan Patent Office, the entire content of which is incorporated herein by reference in its entirety.

BACKGROUND OF THE INVENTION

Field of the Invention

The present invention relates to a boom used in an industrial machine or the like, or more specifically to a structure of a telescopic boom provided to, for example, a mobile crane or the like.

Description of the Related Art

There is conventionally known a telescopic boom assembly including telescopic booms each having a closed section formed by a first frame whose section is substantially U-shaped and a second frame (see Japanese Patent Application Publication No. 2006-21877).

As shown in FIG. 5, a telescopic boom of this type has a first frame 1 whose section is substantially U-shaped and a second frame 2 attached on top of the first frame 1, and forms a closed section with the first frame 1 and the second frame 2.

A small compartment portion 3 is formed at a center portion of the first frame 1, the small compartment portion 3 having an arc section and protruding downward. Small compartment portions 4 and 5 are formed on both sides of the small compartment portion 3, respectively, at positions away from the small compartment portion 3 each by a predetermined distance, the small compartment portions 4 and 5 each having an arc section and protruding outward. The small compartment portions 3 to 5 have the same radius.

Improvement in the buckling strength of the first frame 1 of the telescopic boom is aimed with these three small compartment portions 3 to 5.

Although the above-described telescopic boom aims to improve the buckling strength of the first frame 1 with the three small compartment portions 3 to 5, it is difficult to achieve further improvement in the buckling strength with the structure having the three small compartment portions 3 to 5.

SUMMARY OF THE INVENTION

The present invention has an objective of providing a telescopic boom having high buckling strength.

To achieve the above objective, a telescopic boom according to one embodiment of the present invention includes: a first frame having a curved portion whose section is substantially U-shaped; and a second frame connected to the first frame so that a closed section is formed. In the telescopic boom, a U-shaped curved portion of the first frame includes a plurality of protrusion portions formed at intervals in a circumferential direction of the telescopic boom, each protrusion portion extending in a longitudinal direction of the telescopic boom, and each of the plurality of protrusion portions is formed such that the protrusion portion has an arc-shaped section and protrudes to an outside of the first frame.

DETAILED DESCRIPTION OF THE EMBODIMENT

Embodiments of a telescopic boom according to the present invention are described below with reference to the accompanying drawings.

First Embodiment

Figure 1:
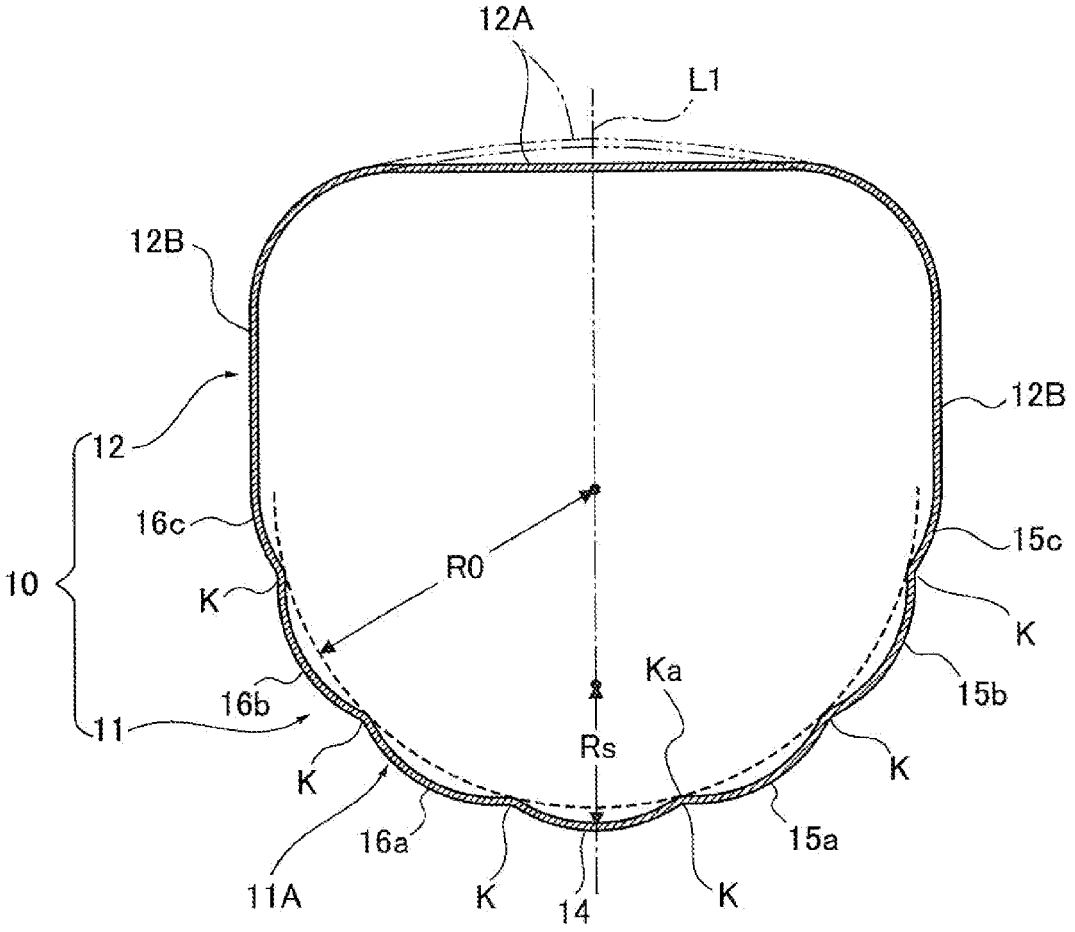
FIG. 1 is a sectional view showing the structure of a telescopic boom according to a first embodiment of the present invention.

FIG. 1 shows a section of a telescopic boom 10 of a telescopic boom assembly (not shown) of a mobile crane according to a first embodiment of the present invention. This telescopic boom 10 has a long first frame 11 having a section of a substantially U-shaped cup and a long second frame 12 having a cup-shaped section and being attached to an upper portion of the first frame 11. The telescopic boom 10 is formed by joining the first frame 11 and the second frame 12 by, for example, welding them together so that the first frame 11 and the second frame 12 form a closed section.

[First Frame]

The first frame 11 has a curved portion 11A formed into a U-shape, and the radius of curvature of the curved portion 11A is set to R0 (see FIG. 1).

A plurality of protrusion portions 14 are formed in the curved portion 11A. These protrusion portions are provided at intervals in a circumferential direction of the telescopic boom 10 and each extend in a longitudinal direction of the telescopic boom 10. Each of the plurality of protrusion portions has an arc section and protrudes to the outside of the first frame 11. The radius of curvature of each protrusion portion 14 is set to Rs, and the radius of curvature R0 is set to be larger than the radius of curvature Rs so that a relational expression Rs<R0 holds true.

In the first embodiment, one protrusion portion 14 is formed at the center portion of the curved portion 11A, and protrusion portions 15*a* to 15*c* and protrusion portions 16*a* to 16*c* are continuously formed on both sides of the protrusion portion 14 located at the center portion, respectively. In this embodiment, the radius of curvature of each of the protrusion portions 15*a* to 15*c* and 16*a* to 16*c* is set equal to the radius of curvature Rs of the protrusion portion 14.

Figure 1A:
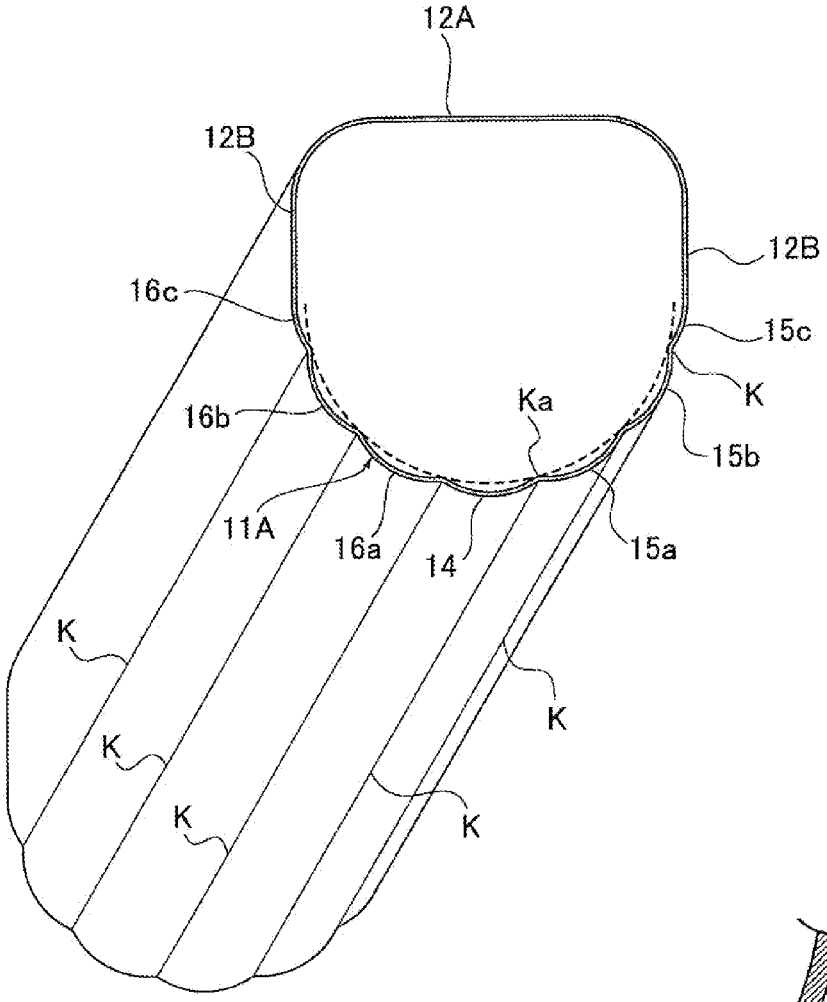
FIG. 1A is a perspective view showing part of the telescopic boom.

The protrusion portions 14, 15*a* to 15*c*, and 16*a* to 16*c* are formed constantly from a lower end to an upper end of the first frame 11 of the telescopic boom 10, or in other words, as they are farther away from the peak (lower end) of the curved portion 11A, as shown in FIG. 1A, so that the amount (height) of each protrusion portion may be constant in the longitudinal direction of the telescopic boom 10 (a direction orthogonal to the paper plane in FIG. 1).

Figure 2:
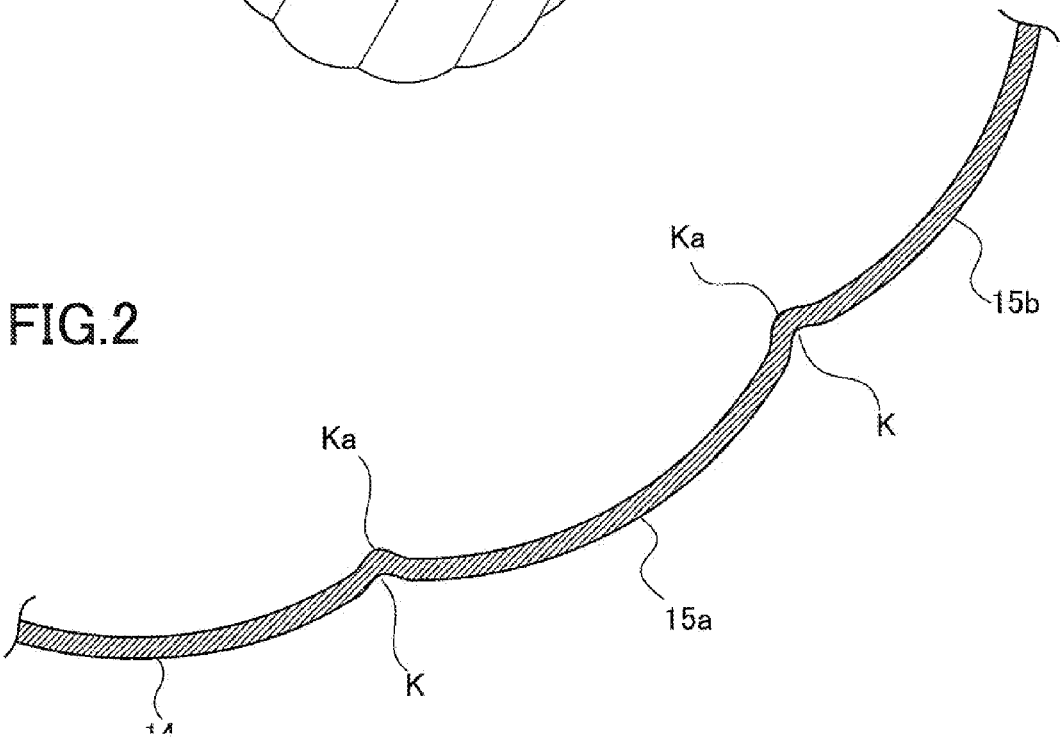
FIG. 2 is a partially-enlarged sectional view of FIG. 1.

As shown in FIG. 2, a joint or node is formed at a border between the protrusion portion 14 and the protrusion portion 15*a*, and this joint is, for example, a recess portion K recessed when seen from the outside of the telescopic boom 10. This recess portion K is formed along the longitudinal direction, as shown in FIG. 1A. On the other side of the telescopic boom 10, this recess portion K is configured to form a ridge portion Ka protruding to the inside of the telescopic boom 10 and extending along the longitudinal direction of the telescopic boom 10.

The recess portion K has an R-shaped section in the embodiment shown, but may have a V-shaped section instead. Every border between adjacent ones of the protrusion portions 15*a* to 15*c*, 14, and 16*a* to 16*c* has the recess portion K similarly.

[Second Frame]

The second frame 12 has a flat upper wall portion 12A and side wall portions 12B, 12B formed continuously on respective sides of the upper wall portion 12A. The upper portion of each of the side wall portions 12B, 12B is formed into an R-shape.

The shape of the first frame 11 and the second frame 12 is symmetrical with respect to a center line L1 of the telescopic boom 10 shown in FIG. 1.

[Operation]

In the telescopic boom 10 configured as above, the plurality of protrusion portions 14, 15*a* to 15*c*, and 16*a* to 16*c* are continuously formed at the curved portion 11A of the first frame 11, and the joint (recess portion K), i.e., the ridge portion Ka is formed between every adjacent ones of the protrusion portions 14, 15*a* to 15*c*, and 16*a* to 16*c*. Thus, compression strength of the first frame 11 in the longitudinal direction thereof is increased, whereby the first frame 11 can be provided with sufficient buckling strength.

In other words, the telescopic boom 10 having the above-described configuration allows enhancement in the buckling strength more than the conventional telescopic boom does.

Second Embodiment

Figure 3:
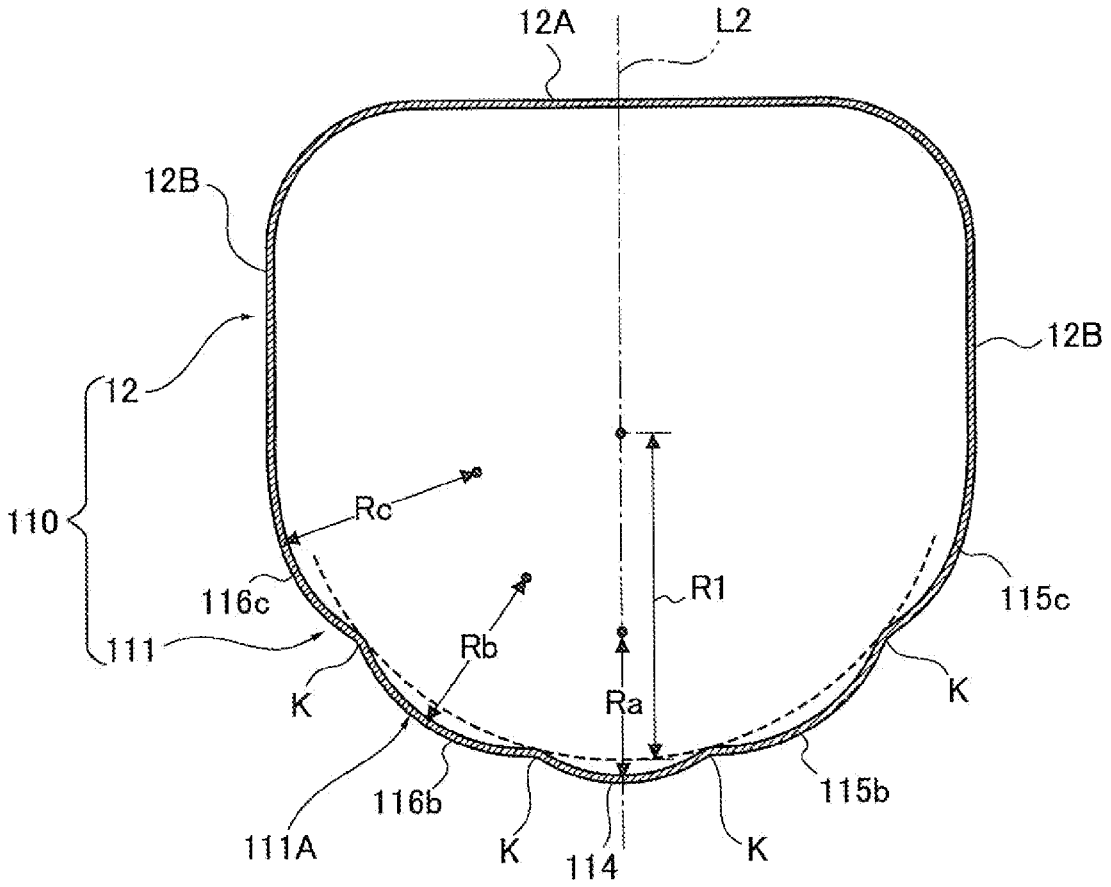
FIG. 3 is a sectional view of a telescopic boom of a second embodiment.

FIG. 3 is a sectional view of a telescopic boom 110 of a second embodiment. The telescopic boom 110 has a first frame 111 having a substantially U-shaped section and a second frame 12 attached to an upper portion of the first frame 111.

The first frame 111 has a curved portion 111A formed into a curved shape, and the radius of curvature of the curved portion 111A is set to R1.

An arc-shaped protrusion portion 114 is formed at a center portion of the curved portion 111A, the protrusion portion 114 protruding outward (downward in FIG. 3). The radius of curvature of the protrusion portion 114 is set to Ra so that Ra<R1 may hold true.

In addition, in the curved portion 111A, protrusion portions 115*b*, 115*c* and protrusion portions 116*b*, 116*c* are formed continuously on both sides of the protrusion portion 114, respectively. The radius of curvature of each of the protrusion portions 115*b*, 116*b* is set to Rb, and that of each of the protrusion portions 115*c*, 116*c* is set to Rc.

The radiuses of curvature Ra to Rc of the protrusion portions 114, 115*b*, 115*c*, 116*b*, and 116*c* are set such that the farther away they are from the curved portion 111A, the larger their radiuses of curvature are. In other words, Ra<Rb<Rc<R1 holds true.

The first frame 111 has a shape symmetrical with respect to a center line L2 of the telescopic boom 110. The recess portion K between each adjacent ones of the protrusion portions 114, 115*b*, 115*c*, 116*b*, and 116*c* is formed along the longitudinal direction of the telescopic boom 110, similarly with the first embodiment.

According to the second embodiment, the radius of curvature Ra of the protrusion portion 114 at the center portion of the first frame 111 on which the largest compression force acts is set to be small. Thus, an effect similar to that offered by the first embodiment can be offered. Moreover, the radiuses of curvature Rb and Rc of the protrusion portions 115*b*, 115*c*, 116*b*, and 116*c* located at the sides where a smaller compression force acts are set to be large. Thus, the number of the protrusion portions 114, 115*b*, 115*c*, 116*b*, and 116*c* can be reduced to thereby reduce man-hours for the work of processing them.

Although being flat in both of the embodiments above, the upper wall portion 12A of the second frame 12 may be formed to have an arc section protruding upward, as shown with chain lines in FIG. 1. This way, the buckling strength of the first frame 11 or 111 of the telescopic boom 10 or 110 can be increased even more.

In addition, although the peak of the protrusion portion 14 or 114 is located at the center portion of the first frame 11 or 111 in the above embodiments, the protrusion portions may be provided such that the joint between one protrusion and another protrusion is located at the center portion. In this case, the radiuses of curvature of the protrusion portions located on both sides of the joint are set to be the same so that the first frame 111 may be symmetrical with respect to the center line L2.

The telescopic boom 10 or 110 in the above embodiments may be applied to any telescopic boom of the telescopic boom assembly, but is designed to be applied to one required to have high strength. Thus, the telescopic boom 10 or 110 is preferably applied to an intermediate telescopic boom or a top telescopic boom.

Figure 4:
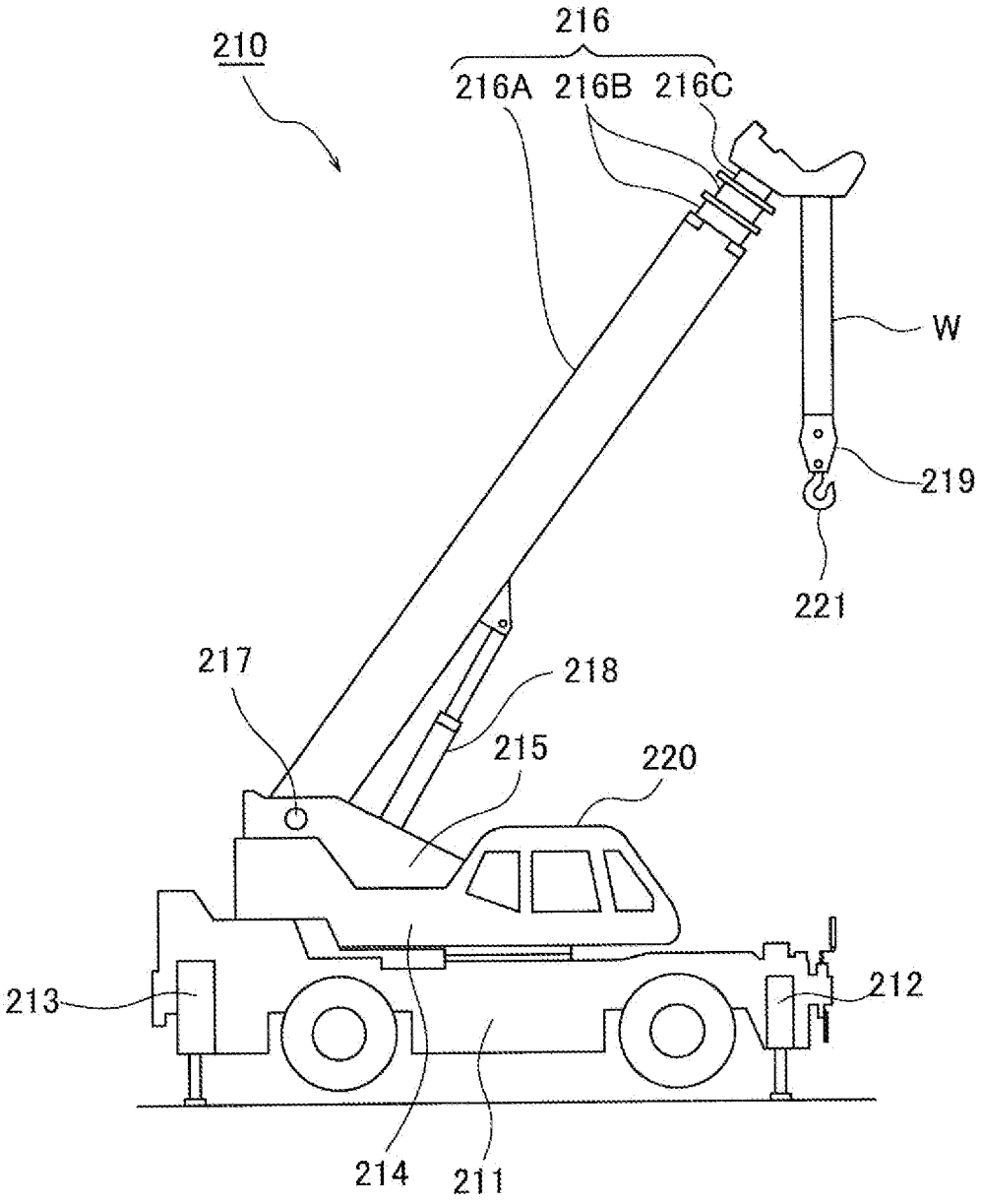
FIG. 4 is a side view of a mobile crane equipped with the telescopic boom of the present invention.
Figure 5:
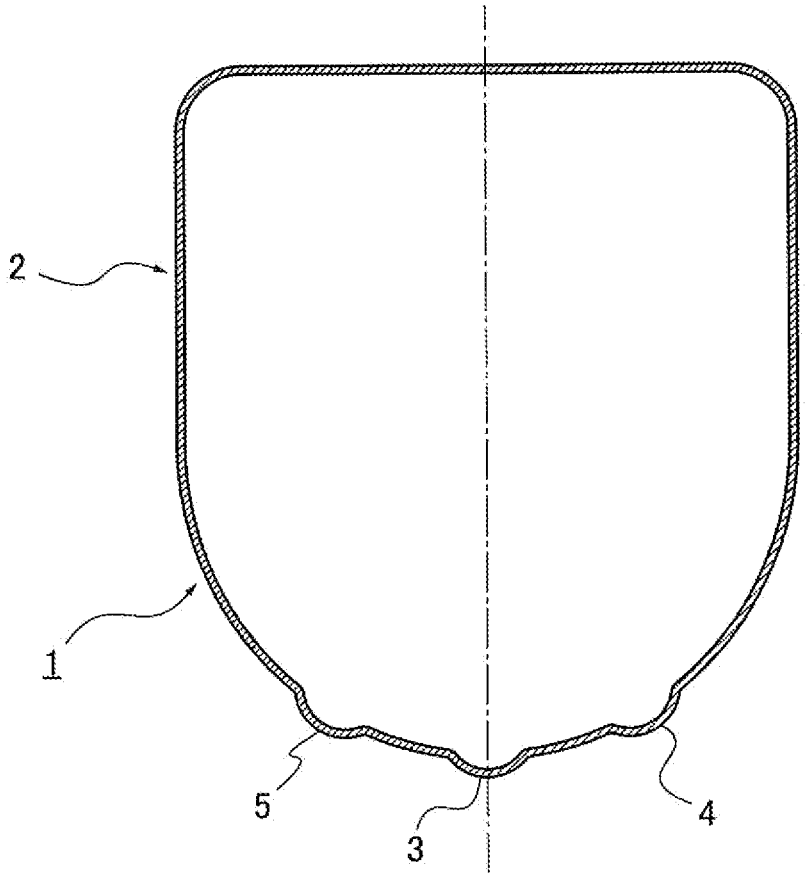
FIG. 5 is a sectional view showing a conventional telescopic boom.

FIG. 4 shows a rough terrain crane 210, a mobile crane, which uses the telescopic boom 10 or 110 of the above embodiments.

The rough terrain crane 210 includes: a carrier 211 which is the main body of a vehicle having a travelling function; a left-and-right pair of front outriggers 212 provided to a front side of the carrier 211; a left-and-right pair of rear outriggers 213 provided to a rear side of the carrier 211; a slewing platform 214 attached to an upper portion of the carrier 211 such that it can slew horizontally; a cabin 220 provided to the slewing platform 214; a telescopic boom assembly 216 attached to a bracket 215 fixed to the slewing platform 214; and the like.

The telescopic boom assembly 216 is attached at its base end portion to the bracket 215 via a support shaft 217, and can be hoisted up or down about the support shaft 217. A hoisting cylinder 218 is interposed between the bracket 215 and the telescopic boom assembly 216, and telescopic motion of this hoisting cylinder 218 enables the telescopic boom assembly 216 to be hoisted up and down.

The telescopic boom assembly 216 has a base boom 216A, an intermediate boom 216B, and a top boom 216C, and is configured such that the top boom 216C is nested inside the intermediate boom 216B, which is then nested inside the base boom 216A. The telescopic boom assembly 216 is configured to be extended and retracted by a telescopic cylinder (not shown).

The intermediate boom 216B and the top boom 216C have the same structure as the telescopic boom 10 or the telescopic boom 110.

The top boom 216C is provided, at its tip end portion, with a sheave (not shown) around which a wire W is hung. The wire W suspends a hook block 219 to which a hook 221 is attached.

The wire W is reeled in or out by a winch (not shown).

In both of the embodiments above, the protrusion portions 14, 15*a* to 15*c*, and 16*a* to 16*c*, or 114, 115*b*, 115*c*, 116*b*, and 116*c* are formed along an arc of the radius of curvature R0 or R1, and the recess portions K are in contact with the arc of the radius of curvature R0 or R1. Instead, the recess portions K may be away from the arc. For instance, the arc may be elliptical, and the protrusion portions 14, 15*a* to 15*c*, and 16*a* to 16*c*, or 114, 115*b*, 115*c*, 116*b*, and 116*c* may be formed along the ellipse.

It should be understood that the prevent invention is not limited to the embodiments described above and can be changed or modified variously by those skilled in the art without departing from the spirit of the invention according to the claims.

What is claimed is:

1. A telescopic boom comprising:

a first frame whose section is U-shaped, the U-shaped first frame comprising a curved portion intersecting points on a curve having a constant radius of curvature; and a second frame connected to the first frame so that a closed section is formed, wherein the curved portion includes a plurality of protrusion portions arranged in a circumferential direction of the telescopic boom, each of the plurality of protrusion portions has an arc-shaped section and protrudes from the curve having the constant radius toward an outside of the telescopic boom, the arc-shaped sections of each adjacent ones of the plurality of protrusion portions have radiuses that overlap each other, and a joint is formed at a border between each adjacent ones of the plurality of protrusion portions, the joint comprising a ridge portion provided on an inner surface of the telescopic boom within the radiuses of the arc-shaped sections of the corresponding adjacent ones of the plurality of protrusion portions, wherein each protrusion portion extends in a longitudinal direction of the telescopic boom, wherein the plurality of arc-shaped protrusion portions are continuously arranged toward both sides of a center line of the telescopic boom along the curved portion from a position on the center line of the telescopic boom, the arc-shaped sections of the plurality of arc-shaped protrusion portions are arranged to have different radiuses to each other, the radiuses of the arc-shaped sections of the plurality of arc-shaped protrusion portions increase as the protrusion portions are farther away from the center line of the telescopic boom, and each joint comprises a point intersecting the curve having the constant radius.

2. The telescopic boom according to claim 1, wherein one of the plurality of protrusion portions is positioned at a center portion on the center line of the curved portion of the first frame, and the other protrusion portions are symmetrically arranged on both sides of the one protrusion portion positioned at the center portion.

3. The telescopic boom according to claim 2, wherein the telescopic boom is at least one of an intermediate boom and a top boom in a telescopic boom assembly having a base boom, the intermediate boom and the top boom.

4. A mobile crane comprising the telescopic boom according to claim 2.

5. The telescopic boom according to claim 1, wherein the telescopic boom is at least one of an intermediate boom and a top boom in a telescopic boom assembly having a base boom, the intermediate boom and the top boom.

6. A mobile crane comprising the telescopic boom according to claim 1.

* * * * *